US009514768B2

(12) United States Patent
Jeong et al.

(10) Patent No.: US 9,514,768 B2
(45) Date of Patent: Dec. 6, 2016

(54) AUDIO REPRODUCING METHOD, AUDIO REPRODUCING APPARATUS THEREFOR, AND INFORMATION STORAGE MEDIUM

(75) Inventors: Jong-hoon Jeong, Suwon-si (KR); Chul-woo Lee, Anyang-si (KR); Nam-suk Lee, Suwon-si (KR); Sang-hoon Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 861 days.

(21) Appl. No.: 13/198,914

(22) Filed: Aug. 5, 2011

(65) Prior Publication Data

US 2012/0035938 A1 Feb. 9, 2012

Related U.S. Application Data

(60) Provisional application No. 61/371,294, filed on Aug. 6, 2010.

(30) Foreign Application Priority Data

Jun. 2, 2011 (KR) ..... 10-2011-0053370

(51) Int. Cl.

| | |
|---|---|
| ***G10L 19/00*** | (2013.01) |
| ***G10L 25/78*** | (2013.01) |
| *G10L 19/008* | (2013.01) |
| *G10L 19/24* | (2013.01) |

(52) U.S. Cl.

CPC ..... *G10L 25/78* (2013.01); *G10L 19/008* (2013.01); *G10L 19/24* (2013.01)

(58) Field of Classification Search

CPC ..... G10L 25/78; G10L 19/008; G10L 19/24
USPC ..... 704/500
See application file for complete search history.

(56) References Cited

U.S. PATENT DOCUMENTS

| | | | | |
|---|---|---|---|---|
| 6,675,148 | B2 | 1/2004 | Hardwick | |
| 7,058,571 | B2 | 6/2006 | Tsushima et al. | |
| 7,133,334 | B2 | 11/2006 | Verbakel et al. | |
| 7,149,159 | B2 * | 12/2006 | Oomen et al. | 369/47.13 |
| 7,343,285 | B1 * | 3/2008 | Reinecke | 704/229 |
| 7,543,217 | B2 | 6/2009 | Sako et al. | |

(Continued)

FOREIGN PATENT DOCUMENTS

| | | |
|---|---|---|
| CN | 1244944 A | 2/2000 |
| CN | 1364297 A | 8/2002 |

(Continued)

OTHER PUBLICATIONS

Ziegler et al, "Enhancing mo3 with SBR: Features and Capabilities of the new mp3PRO Algorithm," Audio Engineering Society 112th Convention Paper 55609, May 2002.*

(Continued)

*Primary Examiner* — David Hudspeth
*Assistant Examiner* — Oluwadamilola M Ogunbiyi
(74) *Attorney, Agent, or Firm* — Sughrue Mion, PLLC

(57) ABSTRACT

An audio reproducing method for quickly and correctly extracting extra data, including: receiving a data stream including the extra data including an end marker disposed immediately before main data and data length information, which is length information of the extra data, disposed immediately before the end marker; checking the presence/absence of the end marker; and if the end marker exists, extracting the extra data by using the data length information.

18 Claims, 7 Drawing Sheets

(56) References Cited

U.S. PATENT DOCUMENTS

| | | | | |
|---|---|---|---|---|
| 8,326,609 | B2 * | 12/2012 | Oh | 704/206 |
| 8,433,584 | B2 | 4/2013 | Kim et al. | |
| 2003/0004708 | A1 | 1/2003 | Oomen et al. | |
| 2005/0081134 | A1 | 4/2005 | Schroeder | |
| 2006/0047521 | A1 * | 3/2006 | Feng et al. | 704/500 |
| 2006/0133512 | A1 * | 6/2006 | Park | H04N 19/61 375/240.25 |
| 2008/0025519 | A1 | 1/2008 | Yu et al. | |
| 2009/0234656 | A1 * | 9/2009 | Oh et al. | 704/500 |
| 2010/0145714 | A1 * | 6/2010 | Zhou et al. | 704/500 |

FOREIGN PATENT DOCUMENTS

| | | | | |
|---|---|---|---|---|
| CN | 1463442 | A | 12/2003 | |
| CN | 1589468 | A | 3/2005 | |
| CN | 2929904 | Y | 8/2007 | |
| CN | 101105940 | A | 1/2008 | |
| CN | 101180674 | A | 5/2008 | |
| CN | 101401455 | A | 4/2009 | |
| EP | 1146730 | A2 * | 10/2001 | H04N 5/00 |
| EP | 1315148 | A1 * | 5/2003 | G10L 19/14 |
| KR | 2000-0014812 | A | 3/2000 | |
| KR | 10-2007-0003593 | A | 1/2007 | |
| KR | 1020110018731 | A | 2/2011 | |
| TW | 200605519 | A | 2/2006 | |

OTHER PUBLICATIONS

Bosi et al, "ISO/IEC MPEG-2 Advanced Audio Coding," Journal of Audio Engineering Society, vol. 45 No. 10, pp. 789-814, Oct. 1997.*

Konstantinos Konstantinides, "Fast Subband Filtering in MPEG Audio Coding", IEEE Signal Processing Letters, vol. 1, No. 2, Feb. 1994, pp. 26-28.

"Information technology—Coding of moving pictures and associated audio for digital storage media at up to about 1,5 Mbit/s -", International Standard ISO/IEC 11 172-3:1993, Technical Corrigendum 1, Joint Technical Committee ISO/IEC JTC 1, Apr. 15, 1996, Total 159 pages.

K Suresh, and T. V. Sreenivas, "Linear Filtering in MDCT domain", Audio Engineering Society, Convention Paper 7340, Presented at the 124th Convention, May 17-20, 2008 Amsterdam, The Netherlands, Total 7 pages.

Douglas S. Brungart, "Auditory localization of nearby sources. III. Stimulus effects", J. Acoust. Soc. Am. 106, 3589 (1999); http://dx.doi.org/10.1121/1.428212, Total 2 pages, Abstract only.

Han-Gil Moon et al., "Reverberation Cue as a Control Parameter of Distance in Virtual Audio Environment", IEICE Trans. Fundamentals, vol. E87-A, No. 5, May 2004, pp. 1-5.

Han-Gil Moon et al., "Auditory Depth Control Using Reverberation Cue in Virtual Audio Environment", IEICE Trans. Fundamentals, vol. E91-A, No. 4, Apr. 2008, pp. 1212-1217.

P. P. Vaidyanathan, "Quadrature Mirror Filter Banks, M-Band Extensions and Perfect-Reconstruction Techniques", IEEE ASSP Magazine, Jul. 1987, pp. 4-20.

Communication dated May 27, 2015, issued by the State Intellectual Property Office of P.R. China in counterpart Chinese Application No. 201110225500.1.

Communication dated Jan. 29, 2015, issued by the State Intellectual Property Office of P.R. China in counterpart Chinese Application No. 201110225498.8.

Communication dated Jan. 5, 2016, issued by the State Intellectual Property of P.R. China in counterpart Chinese Application No. 201110225500.1.

* cited by examiner

AUDIO REPRODUCING METHOD, AUDIO REPRODUCING APPARATUS THEREFOR, AND INFORMATION STORAGE MEDIUM

CROSS-REFERENCE TO RELATED PATENT APPLICATION

This application claims the benefit of U.S. Provisional Application No. 61/371,294 filed on Aug. 6, 2010, in the U.S.P.T.O. and Korean Patent Application No. 10-2011-0053370, filed on Jun. 2, 2011, in the Korean Intellectual Property Office, the disclosures of which are incorporated herein in their entirety by reference.

BACKGROUND

1. Field

The exemplary embodiments relate to an audio reproducing method, an audio reproducing apparatus therefor, and an information storage medium, and more particularly, to an audio reproducing method for quickly extracting and decoding extra data from an audio stream, an audio reproducing apparatus therefor, and an information storage medium.

2. Description of the Related Art

A representative standard for transmitting an audio signal is Moving Picture Experts Group (MPEG). In detail, a standard associated with compression and transmission of an audio signal in the MPEG standard is an MPEG1 Layer-3 (MP3) standard.

In the MP3 standard, a compressible audio signal is limited to 2 stereo channels. To overcome this constraint condition, extra data is allocated to a data stream according to the MP3 standard, and a plurality of channel signals are compressed in the extra data and decoded to be used.

To identify and decode the extra data according to the MP3 standard, all corresponding frames in a data stream must be decoded. That is, the extra data can be extracted and decoded only after decoding all the corresponding frames.

Thus, a method and apparatus for quickly extracting the extra data are required.

SUMMARY

The exemplary embodiments provide an audio reproducing method for quickly extracting and decoding extra data from a data stream, an audio reproducing apparatus therefor, and an information storage medium.

The exemplary embodiments also provide an audio reproducing method for correctly extracting and decoding extra data to decrease a decoding error of the extra data, an audio reproducing apparatus therefor, and an information storage medium.

According to an aspect of an exemplary embodiment, there is provided an audio reproducing method including: receiving a data stream including a header, side information, main data, and extra data including an end marker and data length information, the end marker being disposed immediately before the main data and the data length information, which is length information of the extra data, being disposed immediately before the end marker; checking whether the end marker exists by using start position information of the main data, which is included in the side information; and if the end marker exists, extracting the extra data by using the data length information.

The checking whether the end marker exists may include: shifting to, i.e., reading, a data block disposed immediately before the main data based on the start position information of the main data; and checking whether the end marker exists in the previous data block.

The audio reproducing method may further include decoding the extracted extra data.

The extracting of the extra data may include: if the end marker exists, extracting the data length information disposed immediately before the end marker; calculating a position of the extra data by using at least one from among the end marker, the start position information of the main data, and the data length information; and extracting and decoding the extra data.

The receiving of the data stream may include receiving the data stream including the extra data further including a start marker disposed in a start position of the extra data, extra main data following the start marker, the data length information, and the end marker.

The extracting of the extra data may further include: calculating a start position of the extra data by using at least one from among the start position information of the main data, the end marker, and the data length information; and checking whether the start marker exists in the start position.

The extracting of the extra data may further include, if the start marker exists, extracting and decoding the extra data.

The audio reproducing method may further include: searching for a synchronization word included in the header; and decoding the header and the side information by using the found synchronization word.

According to another aspect of an exemplary embodiment, there is provided an audio reproducing apparatus including: an audio input unit for receiving a data stream including a header, side information, main data, and extra data including an end marker and data length information, the end marker being disposed immediately before the main data and data length information, which is length information of the extra data, being disposed immediately before the end marker; and a decoder for checking whether the end marker exists by using start position information of the main data, which is included in the side information, and if the end marker exists, extracting the extra data by using the data length information.

According to another aspect of an exemplary embodiment, there is provided an information storage medium storing a data stream including: a header; side information; main data; and extra data including an end marker disposed immediately before the main data and data length information, which is length information of the extra data, disposed immediately before the end marker.

BRIEF DESCRIPTION OF THE DRAWINGS

The above and other features and aspects of the exemplary embodiments will become more apparent by describing in detail exemplary embodiments thereof with reference to the attached drawings in which.

DETAILED DESCRIPTION OF EXEMPLARY EMBODIMENTS

To overcome the channel number limitation in the MP3 standard and expand the number of channels without departing from the MP3 standard, extra data in an MP3 data stream may be used.

The extra data may also be used to increase the performance of an audio reproducing apparatus according to the MP3 standard. For example, multi-channel compression and decompression may be implemented by expanding compression and decompression of a stereo audio signal. In detail, compression and decompression of a multi-channel audio signal may be implemented using a parametric multi-channel compression scheme in the extra data. When a high-frequency area signal of main data is damaged, data for restoring the damaged high-frequency area signal may be inserted into the extra data.

Information, such as lyrics, thumbnail images, multilingual subtitles, a karaoke function, and virtual surround, may be additionally provided by using an extra data field. Learning data information may be provided to a user together with or separately from audio data by inserting the learning data information into the extra data field.

As described above, various and convenient functions may be provided using extra data. Thus, an audio reproducing method for quickly and correctly decoding extra data and providing the decoded extra data to a user and an audio reproducing apparatus therefor are described in detail below.

Figure 1:
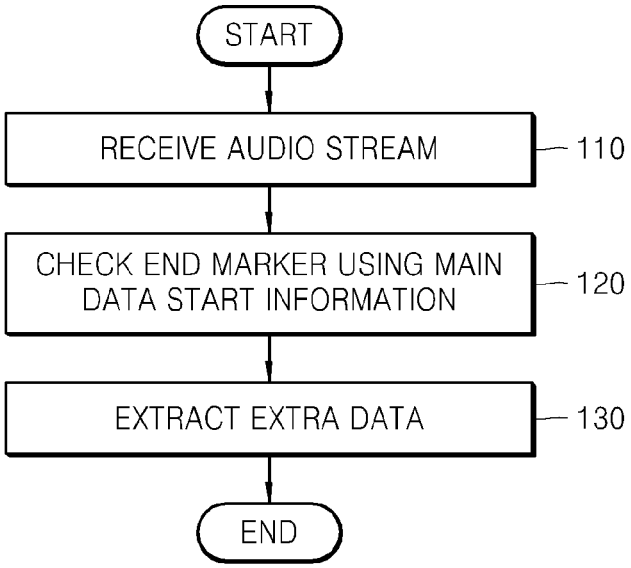
FIG. 1 is a flowchart illustrating an audio reproducing method according to an exemplary embodiment.

FIG. 1 is a flowchart illustrating an audio reproducing method according to an exemplary embodiment.

Referring to FIG. 1, a data stream is received in operation 110. In detail, the data stream is an audio stream for reproducing an audio signal. A case where the received data stream is an audio stream will be described as an example with reference to FIGS. 2 to 8. A structure of the audio stream received in operation 110 is described in detail with reference to FIG. 2.

Figure 2:
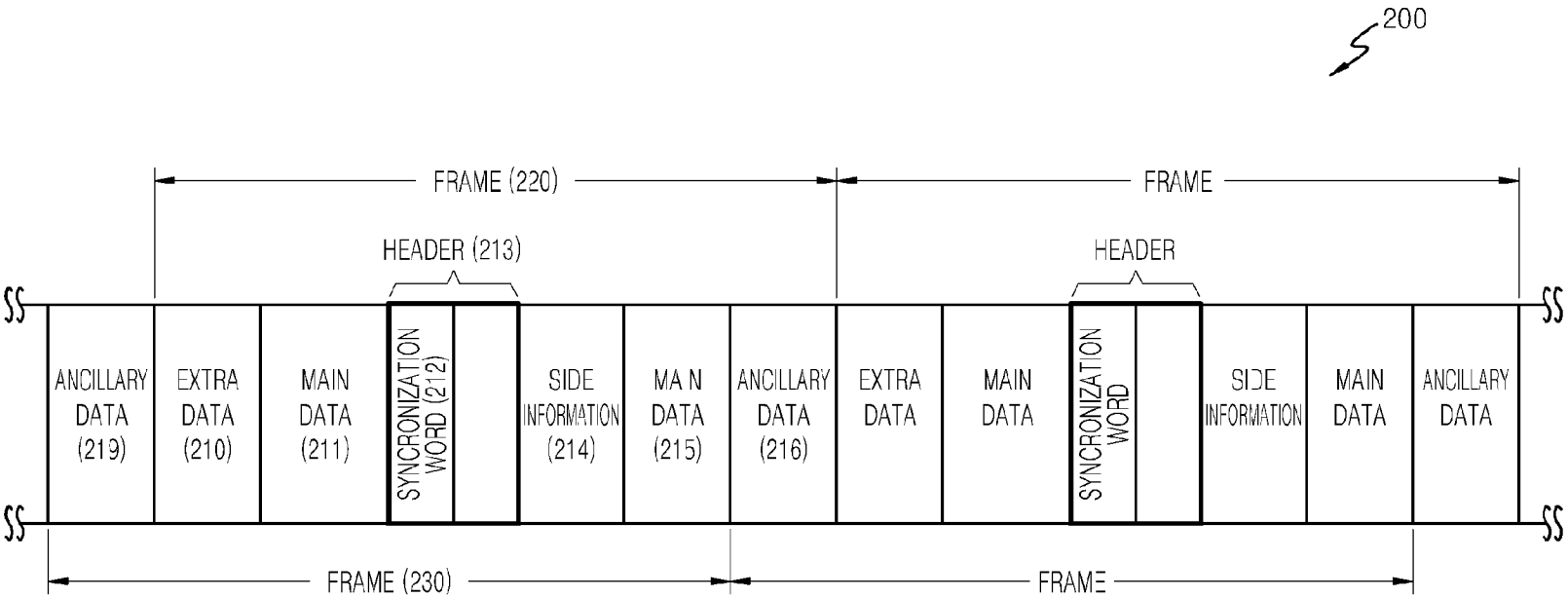
FIG. 2 is a configuration diagram illustrating a structure of a data stream stored in an information storage medium according to an exemplary embodiment.

FIG. 2 is a configuration diagram illustrating a structure of a data stream 200 stored in an information storage medium according to an exemplary embodiment.

Referring to FIG. 2, the audio stream 200 includes consecutive frames. A single frame 220 includes a header 213 and payload data. The payload data is the remaining data other than the header 213 in the frame 220. In detail, the frame 220 of the audio stream 200 includes the header 213, side information 214, main data 211 and 215, and extra data 210. The frame 220 may further include ancillary data 216.

According to the MP3 standard, the header 213 and the side information 214 have fixed lengths, and the other data, i.e., the main data 211 and 215, the extra data 210, and the ancillary data 216, have variable lengths. For example, the header 213 has a length of 32 bits, and the side information 214 has a length of 256 bits in case of audio data. The main data 211 and 215 do not have a fixed position in the frame 220. Thus, the header 213 and the side information 214 may be disposed between the main data 211 and 215.

The header 213 includes a synchronization word 212. The synchronization word 212 is an identification (ID) indicating a start position of the header 213. Thus, the start position of the header 213 may be obtained by extracting the synchronization word 212.

The header 213 includes information required to reproduce actual audio data, i.e., the main data 215. In detail, the header 213 may include an MPEG audio version ID, a bit rate, a sampling frequency, a padding bit, a channel mode, and the number of channels.

The side information 214 includes information required to decode the main data 215. In detail, the side information 214 includes main data start information main_data_begin indicating a start position of the main data 215.

The main data 215 is a field in which actual audio data is carried.

The extra data 210 is a field for recording information required to expand a function of the audio stream 200 as described above. In detail, a portion remaining by excluding at least the main data 211 and 215 including the actual audio data, the header 213 and the side information 214 in the single audio stream 200 is utilized as the extra data 210.

A detailed structure of the extra data 210 will be described in detail with reference to FIG. 3 below.

The ancillary data 216 is data remaining in the frame 220 for performing a buffer control. Actual data is not inserted into the ancillary data 216. That is, when the audio stream 200 is decoded, the ancillary data 216 is read and discarded.

The data from the extra data 210 to the ancillary data 216 may form the frame 220. Instead, the data from ancillary data 219 to the main data 215 may be defined as a single frame 230.

In the audio stream 200 used in the exemplary embodiment, the extra data 210 is disposed immediately before the first main data 211 as shown in FIG. 2. In an exemplary embodiment, the first main data 211 may be the first main data that is transmitted or received before the next main data is transmitted or received, in a frame. The main data start information main_data_begin indicates a start position of the first coming main data 211 among the main data 211 and 215. In detail, as shown in FIG. 3, the extra data 210 is disposed immediately before the start position of the first coming main data 211 indicated by the main data start information main_data_begin.

Figure 3:
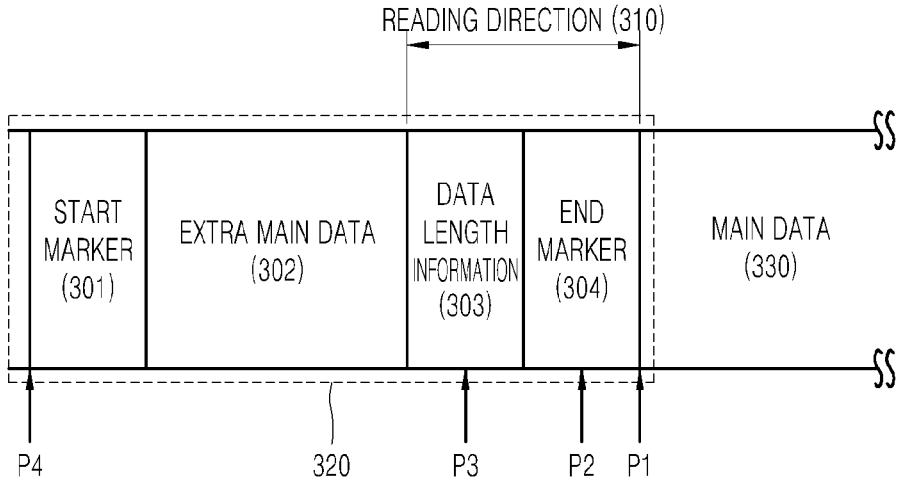
FIG. 3 is a configuration diagram illustrating a structure of extra data used in the present invention.

FIG. 3 is a configuration diagram illustrating a structure of extra data 320 used in the exemplary embodiment. Since the extra data 320 and main data 330 in FIG. 3 respectively correspond to the extra data 210 and main data 211 in FIG. 2, the description made in FIG. 2 is not repeated herein.

Referring to FIG. 3, the extra data 320 includes data length information 303 and an end marker 304. The extra data 320 further includes extra main data 302.

The extra main data 302 is a data field including actual data for a function expansion of an audio stream.

The end marker 304 is a data field for marking an end position P1 of the extra data 320. The end marker 304 may include information indicating that the presence of the extra data 320 is valid. The end position P1 of the extra data 320 is a start position of the main data 330.

The data length information 303 is information indicating a total length of the extra data 320. The data length information 303 is disposed immediately before the end marker 304.

The extra data 320 may further include a start marker 301. The start marker 301 is a data field for marking a start position P4 of the extra data 320.

Referring to FIG. 3, in the extra data 320, the start marker 301, the extra main data 302, the data length information 303, and the end marker 304 may be sequentially disposed.

Operations 120 and 130 of FIG. 1 will now be described with reference to FIGS. 1, 2, and 3.

In operation 120, it is determined whether the end marker 304 exists, using the main data start information main_data_begin included in the side information 214. Operation 120 will be described in detail with reference to FIG. 4 later.

If the end marker 304 exists, the extra data 320 is extracted by using the data length information 303 of the extra data 320 in operation 130.

In detail, the start position P4 of the extra data 320 may be obtained by subtracting a data length according to the data length information 303 from the end position P1 of the extra data 320. That is, if it is determined that the end marker 304 exists, it can be considered that the presence of the extra data 320 is valid. In other words, with the start position P4 of the extra data 320 and the end position P1 of the extra data 320, the extra data 320 may be extracted.

Figure 4:
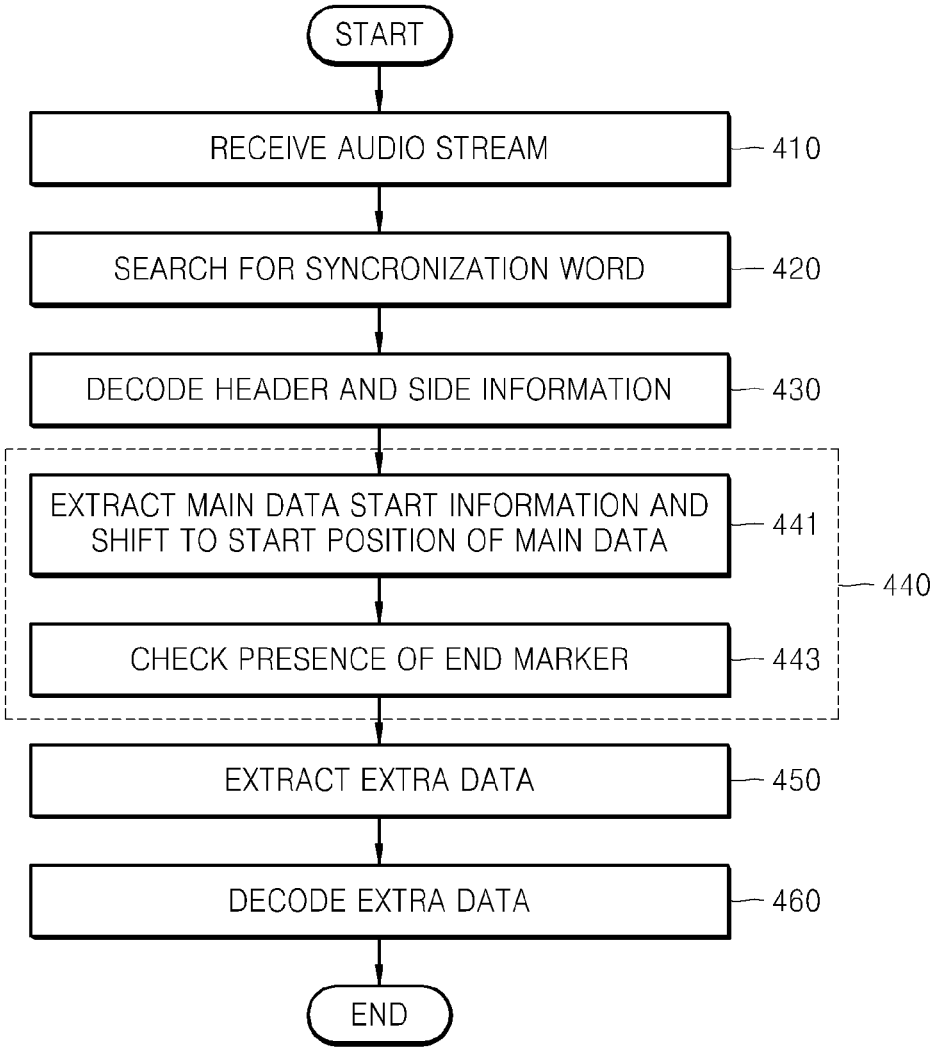
FIG. 4 is a flowchart illustrating an audio reproducing method according to another exemplary embodiment.

FIG. 4 is a flowchart illustrating an audio reproducing method according to another exemplary embodiment. Operations 410 and 450 in FIG. 4 correspond to operations 110 and 130 in FIG. 1, respectively. Operation 440 including operations 441 and 443 in FIG. 4 corresponds to operation 120 in FIG. 1. The description made in FIG. 1 is not repeated herein. The audio reproducing method according to another exemplary embodiment may further include at least one from among operations 420, 430, and 460.

Referring to FIG. 4, in operation 410, an audio stream is received. The audio stream received in operation 410 may be the audio stream 200 described in FIG. 2 or the audio stream described in FIG. 3. Operations 420 and 430 are described with reference to FIGS. 2, 3, and 4.

In operation 420, the synchronization word 212 included in the header 213 is searched for in the received audio stream 200.

In operation 430, the header 213 and the side information 214 are decoded using the found synchronization word 212. Since the synchronization word 212 is an ID indicating the start position of the header 213, the start position of the header 213 may be sensed by finding the synchronization word 212.

By decoding the side information 214, start position information main_data_begin of the main data 211 indicating the start position of the main data 211 may be obtained.

Thus, in operation 441, the main data start information main_data_begin is extracted by decoding the side information 214 to shift to, i.e., to read, the start position P1 of the main data 211 by using the extracted main data start information main_data_begin.

In operation 443, it is determined whether the end marker 304 of the extra data 320 exists. Operations 441, 443, and 450 are described in detail with reference to FIGS. 3 and 4.

In detail, the process shifts to a data block disposed immediately before the main data 330 based on the start position P1 of the main data 330. That is, the process shifts from the position P1 to a position P2. The end marker 304 of the extra data 320 exists in the data block disposed immediately before the main data 330. Thus, the presence/absence of the end marker 304 can be determined by checking whether the end marker 304 exists in the shifted previous data block.

If it is determined that the end marker 304 exists, this indicates that the presence of the extra data 320 is valid, so the extra data 320 is extracted by using the data length information 303 of the extra data 320 in operation 450.

Figure 5:
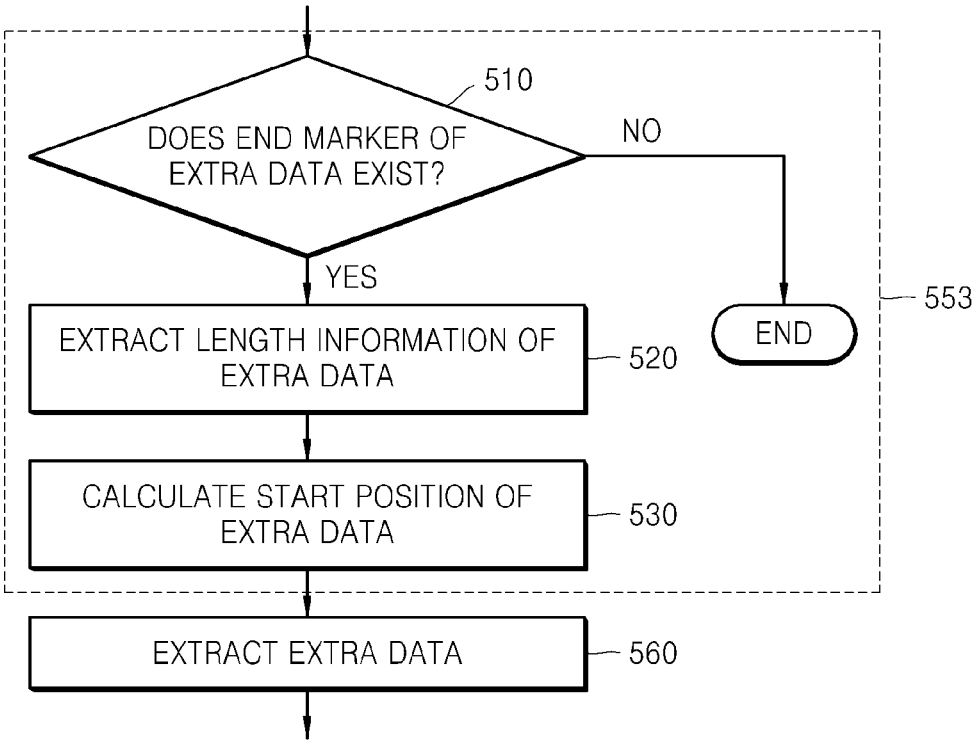
FIG. 5 is a flowchart illustrating operation 443 of FIG. 4 in detail, according to an exemplary embodiment.

FIG. 5 is a flowchart illustrating operation 443 of FIG. 4 in detail, according to an exemplary embodiment. Operations 553 and 560 in FIG. 5 correspond to operations 443 and 450 in FIG. 4, respectively. Thus, operation 510 may be performed after operation 441, and operation 560 identical to operation 450 may be performed after operation 530. The description made in FIG. 4 is not repeated herein.

Referring to FIG. 5, in operation 510, it is determined whether the end marker 304 exists, by shifting to, i.e., reading, a data block disposed immediately before the main data 330 based on the start position P1 of the main data 330.

If the end marker 304 does not exist, it may be determined that the extra data 320 is not present. Thus, if the end marker 304 does not exist, the process ends without extracting or decoding extra data.

If the end marker 304 exists, the data length information 303 of the extra data 320 is extracted by shifting to, i.e., reading, the previous block of the end marker 304 in operation 520.

In detail, the process shifts to a position P3 directing the previous block of the end marker 304. Since the previous block of the end marker 304 includes the data length information 303 of the extra data 320, the data length information 303 may be extracted from the previous block of the end marker 304.

In operation 530, the start position P4 of the extra data 320 is calculated by reading the data length information 303. With the end marker 304 of the extra data 320 or the main data start information main_data_begin and the start position P4 of the extra data 320, a position of the extra data 320 may be obtained.

The extra data 320 is extracted using the calculation result on operation 530 and is decoded in operation 560.

Figure 6:
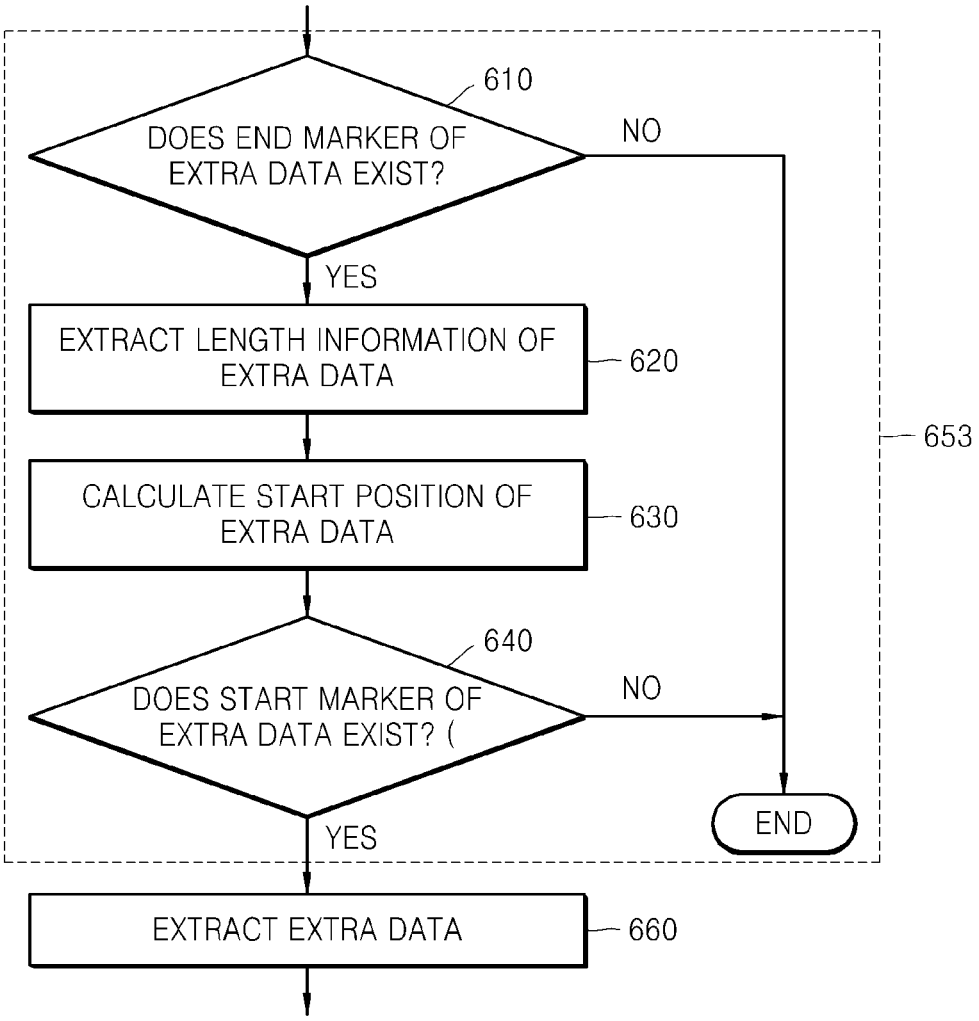
FIG. 6 is a flowchart illustrating operation 443 of FIG. 4 in detail, according to another exemplary embodiment.

FIG. 6 is a flowchart illustrating operation 443 of FIG. 4 in detail, according to another exemplary embodiment. Operations 653 and 660 in FIG. 6 correspond to operations 553 and 560 in FIG. 5, respectively. In addition, operations 653 and 660 in FIG. 6 correspond to operations 443 and 450 in FIG. 4, respectively. The description made in FIGS. 4 and 5 is not repeated herein.

Operations 610, 620, and 630 in FIG. 6 correspond to operations 510, 520, and 530 in FIG. 5, respectively. That is, operation 653 in FIG. 6 may further include operation 640 compared with operation 553 in FIG. 5.

Referring to FIG. 6, in operation 640, it is determined whether the start marker 301 of the extra data 320 exists, by shifting to, i.e., reading, the start position P4 of the extra data 320 calculated in operation 630.

By determining whether the start marker 301 of the extra data 320 exists, it may be determined once again that the extra data 320 is present.

If it is determined in operation 610 that the end marker 304 of the extra data 320 exists and is determined in operation 640 that the start marker 301 of the extra data 320 exists, the extra data 320 is extracted in operation 660.

Conventionally, to use extra data, the extra data can be extracted and decoded only after decoding all frame data. For example, when a thumbnail image associated with main data is stored in extra data, the extra data must be extracted by decoding all main data of received frame data to display the thumbnail image. That is, extra data cannot be directly extracted and decoded without decoding all main data.

The audio reproducing method according to an exemplary embodiment disposes extra data immediately before main data indicated by main data start information main_data_begin. Then, the extra data is read in a direction opposite to an audio stream. That is, the end marker 304 and the data length information 303 of the extra data 320 are read in a reading direction 310 of FIG. 3.

Accordingly, the audio reproducing method according to an exemplary embodiment may correctly extract extra data even before decoding all main data.

Thus, the extract extra may be quickly decoded and used.

The audio reproducing method according to another exemplary embodiment extracts extra data after determining whether an end marker of the extra data exists or whether the end marker and a start marker of the extra data exist. According to the audio reproducing method according to another exemplary embodiment, by extracting extra data only if the presence of the extra data is valid, a decoding error occurring by wrongly extracting extra data or extracting invalid extra data may be prevented.

Figure 7:
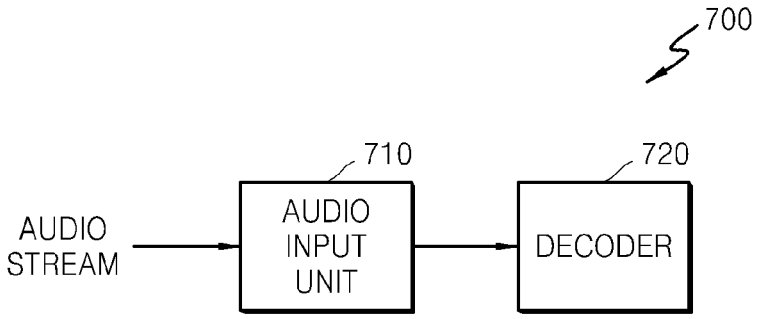
FIG. 7 is a block diagram of an audio reproducing apparatus according to an exemplary embodiment.

FIG. 7 is a block diagram of an audio reproducing apparatus 700 according to an exemplary embodiment.

Referring to FIG. 7, the audio reproducing apparatus 700 includes an audio input unit 710 and a decoder 720. The audio reproducing apparatus 700 receives and decodes an audio stream as described in FIGS. 2 and 3. The audio reproducing apparatus 700 is described with reference to FIGS. 2, 3, and 7.

The audio input unit 710 receives a data stream including the header 213, the side information 214, the main data 211 and 215, and the extra data 210 disposed immediately before the main data 211. The data stream may be an audio stream including consecutive frames.

In detail, the audio stream 200 includes the extra data 320 including the end marker 304 disposed immediately before the main data 330 and the data length information 303 disposed immediately before the end marker 304.

In detail, the audio input unit 710 performs operation 110 of FIG. 1 and operation 410 of FIG. 4 described above.

The decoder 720 determines whether the end marker 304 exists, using the main data start information main_data_begin included in the side information 214°, and if the end marker 304 exists, the decoder 720 extracts the extra data 320 by using the data length information 303.

In detail, the decoder 720 performs operations 120 and 130 of FIG. 1 described above. The decoder 720 may perform at least one from among operations 420, 430, 440, 450, and 460 of FIG. 4 described above. The decoder 720 may perform operations 553 and 560 of FIG. 5 described above. The decoder 720 may perform operations 653 and 660 of FIG. 6 described above. The description made in FIGS. 1, 4, 5, and 6 is not repeated herein.

The decoder 720 shifts to, i.e., reads, a data block disposed immediately before the main data 330 based on the start position P1 of the main data 330 and determines whether the end marker 304 exists in the previous data block. If it is determined that the end marker 304 exists, the decoder 720 extracts and decodes the extra data 320.

Alternatively, if the end marker 304 exists, the decoder 720 extracts the data length information 303 disposed immediately before the end marker 304 and extracts and decodes the extra data 320 by calculating a position of the extra data 320 using at least one from among the end marker 304 and the extracted data length information 303.

Alternatively, the decoder 720 calculates the start position P4 of the extra data 320 by using at least one from among the end marker 304 and the data length information 303. Thereafter, the decoder 720 determines whether the start marker 301 exists in the start position P4. If the start marker 301 exists, the decoder 720 extracts and decodes the extra data 320

Figure 8:
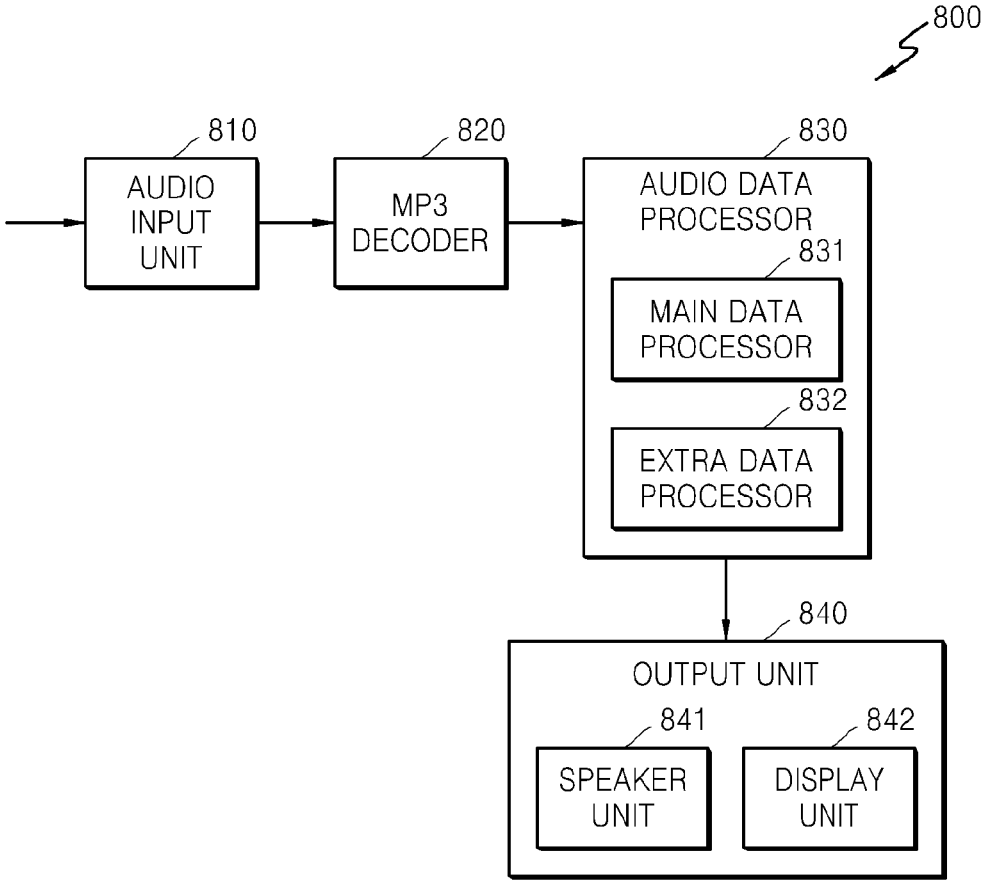
FIG. 8 is a block diagram of an audio reproducing apparatus according to another exemplary embodiment.

FIG. 8 is a block diagram of an audio reproducing apparatus 800 according to another exemplary embodiment. An audio input unit 810 and an MP3 decoder 820 in FIG. 8 correspond to the audio input unit 710 and the decoder 720 in FIG. 7, respectively. Thus, the description made in FIG. 7 is not repeated herein.

Although the MP3 decoder 820 corresponds to the decoder 720 of FIG. 7, the MP3 decoder 820, in detail, decodes audio data according to the MP3 standard. The MP3 decoder 820 extracts and decodes the header 213 and the side information 214 and accordingly extracts and decodes the main data 211 and 215. Thereafter, the MP3 decoder 820 extracts and decodes the extra data 210. The decoding of the extra data 210 and the main data 211 and 215 may be performed at the same time or sequentially.

The audio reproducing apparatus 800 of FIG. 8 further includes an audio data processor 830 and an output unit 840 compared with the audio reproducing apparatus 700 of FIG. 7.

The audio data processor 830 receives the decoded main data 211 and 215 and the decoded extra data 210 from the MP3 decoder 820 and converts the decoded main data 211 and 215 and the decoded extra data 210 to a signal visually and audibly recognized by a user.

In detail, the audio data processor 830 includes a main data processor 831 and an extra data processor 832.

The main data processor 831 receives the decoded main data 211 and 215 and converts the decoded main data 211 and 215 to a signal audibly recognized by the user. The main data processor 831 may also perform noise cancellation processing and error check processing to improve sound quality of an audio signal.

The extra data processor 832 receives the decoded extra data 210 and converts the decoded extra data 210 to a corresponding image and sound signal. For example, when the extra data 210 is data for outputting lyrics corresponding to the main data 211 and 215, the extra data processor 832 may convert the lyrics data included in the extra data 210 to text data and convert the text data to a graphic signal to display the converted text data to a predetermined screen.

The output unit 840 outputs an audio signal or an image signal for the user to recognize it audibly or visually.

In detail, the output unit 840 may include a speaker unit 841 and a display unit 842. The speaker unit 841 outputs an audio signal audibly recognized by the user. The display unit 842 displays a predetermined image. For example, the display unit 842 may display subtitles, a thumbnail image, or learning data information.

The operations of the audio reproducing apparatuses 700 and 800 described with reference to FIGS. 7 and 8 are substantially identical to operations of the audio reproducing methods described with reference to FIGS. 1 to 6. Thus, the description made in the audio reproducing methods with reference to FIGS. 1 to 6 is not repeated in the audio reproducing apparatuses 700 and 800 with reference to FIGS. 7 and 8.

The method invention can also be embodied as computer-readable codes or programs on a computer-readable recording medium. The computer-readable recording medium is any data storage device that can store programs or data which can be thereafter read by a computer system. Examples of the computer-readable recording medium include read-only memory (ROM), random-access memory (RAM), CD-ROMs, magnetic tapes, hard disks, floppy disks, flash memory, optical data storage devices, and so on. The computer-readable recording medium can also be distributed over network coupled computer systems so that the computer-readable code is stored and executed in a distributed fashion.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An audio reproducing method of an audio reproducing apparatus, the method comprising:

receiving, by the audio reproducing apparatus, a data stream comprising a header, side information, main data, and extra data comprising an end marker and data length information, the end marker being disposed immediately before the main data and immediately after the data length information, which is length information of the extra data;

checking whether the end marker exists by reading a data block disposed immediately before the main data based on start position information of the main data, which is included in the side information;

if the end marker exists, extracting the extra data by reading a previous block of the end marker using the data length information of the extra data; and generating an audio output signal based on the main data and the extracted extra data, wherein the end marker comprises information indicating that a presence of the extra data is valid.

2. The audio reproducing method of claim 1, wherein the checking whether the end marker exists comprises:

checking whether the end marker exists in a previous data block.

3. The audio reproducing method of claim 2, further comprising decoding the extracted extra data.

4. The audio reproducing method of claim 2, wherein the extracting the extra data comprises:

if the end marker exists, extracting the data length information disposed immediately before the end marker;

calculating a position of the extra data by using at least one from among the end marker, the start position information of the main data, and the data length information; and extracting and decoding the extra data.

5. The audio reproducing method of claim 1, wherein in the receiving of the data stream, the extra data further comprises a start marker disposed in a start position of the extra data, extra main data following the start marker.

6. The audio reproducing method of claim 5, wherein the extracting of the extra data comprises:

calculating the start position of the extra data by using at least one from among the start position information of the main data, the end marker, and the data length information; and checking whether the start marker exists in the start position.

7. The audio reproducing method of claim 6, wherein the extracting of the extra data further comprises, if the start marker exists, extracting and decoding the extra data.

8. The audio reproducing method of claim 1, further comprising:

searching for a synchronization word included in the header; and decoding the header and the side information by using the searched for synchronization word.

9. An audio reproducing apparatus comprising:

an audio input receiver which receives a data stream comprising a header, side information, main data, and extra data comprising an end marker and data length information, the end marker being disposed immediately before the main data and immediately after the data length information, which is length information of the extra data;

a decoder which checks whether the end marker exists by reading a data block disposed immediately before the main data based on start position information of the main data, which is included in the side information, and if the end marker exists, and extracts the extra data by reading a previous block of the end marker using the data length information of the extra data;

at least one hardware processor configured to control the audio input receiver and the decoder, and to generate an audio output signal based on the main data and the extracted extra data, wherein the end marker comprises information indicating that a presence of the extra data is valid.

10. The audio reproducing apparatus of claim 9, wherein the decoder checks whether the end marker exists in a previous data block.

11. The audio reproducing apparatus of claim 10, wherein the decoder decodes the extracted extra data.

12. The audio reproducing apparatus of claim 10, wherein the decoder extracts the data length information disposed immediately before the end marker if the end marker exists, calculates a position of the extra data by using at least one from among the end marker, the start position information of the main data, and the data length information, and extracts and decodes the extra data.

13. The audio reproducing apparatus of claim 9, wherein the extra data further comprises:

a start marker disposed in a start position of the extra data; and extra main data following the start marker.

14. The audio reproducing apparatus of claim 13, wherein the decoder calculates the start position of the extra data by using at least one from among the start position information of the main data, the end marker, and the data length information and checks whether the start marker exists in the start position.

15. The audio reproducing apparatus of claim 14, wherein the decoder extracts and decodes the extra data if the start marker exists.

16. A non-transitory computer-readable recording medium having recorded thereon a program, which when executed by a processor of an audio device, to execute an audio processing method, the method comprising:

receiving a data stream comprising:

a header;

side information;

main data; and extra data comprising an end marker and data length information, the end marker being disposed immediately before the main data and immediately after the data length information, which is length information of the extra data;

checking whether the end marker exists by reading a data block disposed immediately before the main data based on start position information of the main data, which is included in the side information;

if the end marker exists, extracting the extra data by reading a previous block of the end marker using the data length information of the extra data; and generating an audio output signal based on the main data and the extracted extra data, wherein the end marker comprises information indicating that a presence of the extra data is valid.

17. The non-transitory computer-readable recording medium of claim 16, wherein the extra data further comprises: a start marker disposed in a start position of the extra data; and extra main data following the start marker.

18. The non-transitory computer-readable recording medium of claim 17, wherein the end marker is a data field for marking an end position of the extra data, and the start marker is a data field for marking the start position of the extra data.

* * * * *